US005813273A

United States Patent [19]

Hongo

[11] Patent Number: 5,813,273

[45] Date of Patent: Sep. 29, 1998

[54] PRESS BRAKE

[75] Inventor: Toshio Hongo, Ichikawa, Japan

[73] Assignee: Maru Kikai Kogya Co., Ltd., Tokyo, Japan

[21] Appl. No.: 866,182

[22] Filed: May 30, 1997

[30] Foreign Application Priority Data

Nov. 12, 1996 [JP] Japan ..... 8-314114

[51] Int. Cl.[6] ..... B21D 5/02

[52] U.S. Cl. ..... 72/389.4; 72/441; 72/446

[58] Field of Search ..... 72/441, 444, 446, 72/389.1, 389.4, 389.5

[56] References Cited

U.S. PATENT DOCUMENTS

| | | | |
|---|---|---|---|
| 3,682,465 | 8/1972 | Hanni | 72/389.5 |
| 4,732,032 | 3/1988 | Kogure | 72/389.5 |
| 4,894,015 | 1/1990 | Houston | 72/389.5 |
| 5,009,098 | 4/1991 | Van Merkssteijn | 72/389.5 |
| 5,067,340 | 11/1991 | MacGregor | 72/389.5 |
| 5,097,694 | 3/1992 | Haennit et al. | 72/389.5 |
| 5,103,665 | 4/1992 | Van Merksteijn | 72/389.5 |

FOREIGN PATENT DOCUMENTS

| | | | |
|---|---|---|---|
| 0237800 | 9/1987 | European Pat. Off. . | |
| 0251287 | 1/1988 | European Pat. Off. . | |
| 2179958 | 11/1973 | France . | |
| 2-46922 A | 2/1990 | Japan | 72/389.5 |

OTHER PUBLICATIONS

Patent Abstracts of Japan, Voltage. 16, No. 557 (M–1340)–Considered particulary relevant Nov. 27, 1992.

*Primary Examiner*—David Jones

[57] ABSTRACT

A press brake for bending a work sheet wherein an upper tool holder is mounted at a lower end of a ram to mount an upper tool and a bending angle of a work sheet is determined by three points of spaced shoulders of a lower tool and a lower tool bottom. The press brake includes a group of pins as pressure transmission members, arranged at symmetrical positions from a machine center line in the upper tool. A space is provided between the tops of some of the pins and a press block. A series of spacers is mounted on a chain mechanism for putting the spacers into and out from the space between the press block and the pins. The effective length of the upper tool is automatically changed corresponding to the bending length of the work sheets so as to achieve an efficient bending of various length work sheets and preventing unequal bending.

11 Claims, 5 Drawing Sheets

PRESS BRAKE

BACKGROUND OF THE INVENTION

1. Field of the Invention

The present invention relates to a press brake, and in particular relates to the press brake for bending a work sheet wherein an optional effective upper tool (upper die) length to be transmitted a pressure can be set from a machine center line and the upper tool portion other than the optional length can be prevented from receiving a transmission of the pressure 2. Description of the prior art Up to now, for V-shape bending process of a work sheet by a press brake, an air bending system of a free bending which upper and lower tools do not touch with each other and a bottoming system of compressing the work sheet strongly by upper and lower tools to press and cut it for bending are usually used.

In the air bending system, the work sheet is bent thus correcting a bending angle in respect of a spring back, however it has been impossible to keep the correct bending angle through a bending process. Therefore recently a complicate cross sectioned product has been achieved by repeating a simple V-shape bending, however there has been a problem that a correct bending angle cannot be kept during a process due to a distortion of a ram or a bed, or a break and an opening of a side frame (such as an deformation of the upside opening of the side frame toward the bed to support the ram) when the work sheet is bent with a medium angle such as an angle of 30°, 60°, 80° and 120° which is out of a standard angle. While the problem described above is not involved in the bottoming system, however it is necessary to change a tool for every different bending angle.

For a countermeasure to a distortion involved in such press brake, a tool height in respect of the tool length direction is corrected to a convex height by an equipment of a wedge on a lower tool so as to make the bent condition of the ram during a process coincidence with a lower tool line. Furthermore the countermeasure to a side frame distortion, a lower limit control valve has been attached on members to be separately mounted for being not effected by a distortion and the work sheet has been processed by pressurizing a maximum pressure having a disregard of a side frame distortion caused by pressurizing.

Furthermore a hydraulic cushion is contained in a split tool upper portion or a lower portion so that a pressure per a work sheet length is made uniform to eliminate a clearance between the upper and the lower tools by the hydraulic cushion function, i.e. the press brake is known that the pressure is adjusted according to a sheet thickness and a V-shape groove width or the work sheet can be bent precisely by a uniform pressure having a disregard of a bending length.

In the press brake, for providing a uniform pressure to the work sheet, for example pressure providing members are arranged at 25 mm pitch distance in a split tool inside to correspond with each 100 mm width standard tool by respective four pins. In bending the smaller width work sheet than the split tool width or in bending the work sheet which end extends over a part of the split tool width by a standard 100 mm width tool, an excess pressure is applied thereon, for example twice pressure is applied on the sheet set on the standard 50 mm width tool, therefore the split tool which may contact with the work sheet end is preliminarily removed or an exchanging to shorter length split tool or to a specific width tool has been tried.

However bending the work sheet by the split upper tool, a little of irregular portion appears on the boundary portion of split upper tool at the bending line, such irregular portion is almost acceptable for finishing a product, however an next process of removing said irregular is required for achieving a precise bending of a stainless steel sheet or the like, furthermore an adjustment of a pressure on the work sheet corresponding to the bending length is required for producing a panel by bending long and short sides.

While by a development of a handling device, it prefers to process the work sheet at the machine center line in every same process steps rather than move the portion to be processed, and it has been required to release the tool extending over the work sheet end portion to attribute an inappropriate bending.

It is an object of the present invention to provide a press brake of a bending machine to be able to change an effect upper tool length automatically corresponding to the bending length of the work sheet without distinction of upper tool constructions such as a single and uniform upper tool relating to a full length of the machine width or a combination of split upper tools. Furthermore it is an object of the present invention to provide a device in which pressure transmission pins are provided between the pressure providing member and the upper tool, a determined number of spacers which are a supplemental pressure transmitting member are inserted orderly into respective upper surface of pressure transmission pin line at the position selected from the machine center line, thereby a distance of a width direction (an effective upper tool length) of upper tool line to be transmitted a pressure from a pressure providing member can be optionally set. Further it is a further object of the present invention to provide a press brake of a bending machine for a precise bending process in preventing an appearance of irregular portion on a bending line wherein an effect length of upper tools can be adjusted by constructing single and uniform upper tool relating to full length of the machine width.

SUMMARY OF THE INVENTION

In order to achieve the above described objects, in the press brake for bending a work sheet of the present invention, an upper tool is mounted in an upper tool holder at a ram bottom end via a cushion provided in the holder and a bending angle of a work sheet is determined by three points such as both shoulders of the lower tool and a lower tool bottom of which height can be adjusted, characterized in that a group of pins (40) as a pressure transmission member arranged at symmetrical positions at certain pitch distance from a machine center line (80) of the upper tool holder (11) inside, a block type pressure providing member (25) including a hydraulic chamber (21) and a rubber sheet (23) and disposed at a lower portion of a hydraulic cushion (20), a series of spacers (37) arranged in capable putting in and out from the clearance between the pressure providing member (25) and a group of pins and a spacer moving means (30) are provided.

Further according to the preferred embodiment of the present invention, a press brake for bending a work sheet consists of a ram (10) elevating by an actuation of a main cylinder, a upper tool holder (11) fixed on a bottom end of the ram, a hydraulic cushion (20) formed by a hydraulic chamber which is arranged over full length of the upper tool holder and a rubber sheet, a pressure providing member (25) arranged at the bottom portion of the hydraulic cushion, an upper tool (12) mounted on the bottom portion of the upper tool holder, a bed (13) and a lower tool (14) mounted on the bed upper surface and having both shoulders (57, 58) and a lower tool bottom member (54) of which height can be adjusted, wherein the upper tool is pressurized by pressing down the ram and a bending angle of the work sheet is determined by three points of both shoulders (57, 58) of the lower tool and the lower tool bottom member (54) which height is adjusted in a condition of providing a uniform hydraulic pressure on the die under the process of the actuation of the main cylinder.

In the press brake according to the present invention, an effect upper tool length can be changed automatically corresponding to the bending length of the work sheet without distinction of upper tool constructions such as a single and uniform upper tool for a full length of the machine width or a combination of split upper tools. Therefore a plurality group of pins (pressure transmission member) are aligned between the pressure providing member and upper tools to activate as the pressure transmission member for the upper tool length corresponding to the bending length of the work sheet, while the upper tool portion other than the above are not effected by a pressure from the pressure providing member.

The upper tool holder (11) includes a plurality of pressure transmission pins (40) symmetrically mounted with a certain pitch distance at left and right positions from a mechanical center line (80) between the pressure providing member (25) and the upper tool (12), clearance (48) formed between a lower surface of the pressure providing member (25) and an upper surface of each pressure transmission pin (40), a series of spacers (37) arranged and connected by a chain (35) for inserting into the clearance (48), and a spacer moving means (30) capable of orderly inserting a predetermined number of spacers (37) in the clearance (48) at the upper surface of each pressure transmission pin (40) through the selected position from the mechanical center line for keeping an effect length of the upper tool to correspond with the bending length of the work sheet.

Further the press brake according to the present invention is constructed that each of pressure transmission pins (40, 40*a*, 40*b*) is inserted into a plurality of holes (46) opened at a lower portion of a vacant space (24) for containing the pressure providing member of the holder (11) inside, respective two pins (40*a*, 40*b*) of left and right sides adjacent to the machine center line (80) are not received the spacer and said pins contact with a lower surface of the block type pressure providing member (25), while a plurality of pins (40) arranged outward from said pins (40*a*, 40*b*) are formed a height lower in proportional to a length through the spacer is inserted and are received a pressure from the pressure providing member (25) via the spacer which is inserted into the pin upper surface so as to transmit the pressure to the upper tool of that portion.

Among pressure transmission pins (40, 40*a*, 40*b*), respective left and right side several pins (40*a*, 40*a*, 40*b*, 40*b*) adjacent to the machine center line (80) are formed in a standard height from the lower surface of the pressure providing member (25) to the upper surface of the upper tool (12) and do not receive the spacer (37) so as to transmit a pressure from the pressure providing member (25) to the upper tool of that portion. A plurality of pins (40) are arranged toward left and right dies longitudinal direction outside from pins (40*b*, 40*b*) having a standard height are formed in a lower height in proportional to the thickness of the spacer than pins (40*b*, 40*b*) so as to transmit a pressure from the pressure providing member (25) via the spacer to the upper tool at that portion.

The spacer moving means (30) comprises a pair of sprockets (33, 34) symmetrically arranged left and right side of the mechanical center line (80), a pair of endless chains (35) stretched between each sprocket (33, 34) to travel in a horizontal surface of the holder (11) inside and provided with a plurality of spacers at a certain pitch distance and a motor for driving the chain, and the endless chains (35, 35) travel in the opposite direction with each other from the mechanical center line (80) for orderly moving the spacer (37) in a refuge position of the holder rear side into respective clearances (48) along left and right tool length directions from the mechanical center line by an actuation in a positive direction and for picking the spacer (37) out from the clearance (48) by an actuation in a reverse direction.

The press brake according to the present invention further includes a means (17) for indicating the upper tool length and the means (17) for indicating the upper tool length comprises a pair of left and right pulleys (26, 28) mounted at the side of the band container groove, indicator bands (18) for indicating the upper tool length pressurized the uniform fluid pressure by a movement of the spacer (37) due to the actuation of each endless chain (35), which rear end is fixed on the attachment (39) of the chain (35) and which forward end side guided by winding the pulleys (26, 28) is inserted in the band container groove (66) and the transparent scale (19) which is mounted and covered over the front surface of the band container groove (66) for viewing the indicator band (18) so as to read the distance between both ends of the indicator band (18, 18) as an effect upper tool length from the minimum upper tool length (1 min) to the maximum upper tool length (1 max) by moving of the indicator band synchronizing with controlling the number of spacers (37) to be inserted.

A colored base plate (65) is fixed on a center portion of a longitudinal direction of the band container groove (66) for indicating the minimum upper tool length (1 min), a front surface of the indicator band (18) inserted into the band container groove (66) is colored in a same color of the base plate (65) and at least vertical wall (67) of the band container groove is colored in a opposite color or in a different color density from the base plate.

Corresponding to the bending length of the work sheet, the drive sprocket is actuated to travel the endless chain so as to adjust the effect length of the upper tool by orderly inserting predetermined number of spacers into the clearance on the upper surface of each pressure transmission pin through the selected position from the machine center line. The travel distance of the indicator band is checked through the transparent scale mounted at the machine front surface to bend the work sheet by actuating the ram.

According to the press brake of the present invention, the effect length of the die can be freely selected by simply inserting the spacer in order into the upper surface of the pressure transmission pin through the selected position from the machine center line toward, the bending work corresponding to the different width of long and short sides of the work sheet in preventing the die from disproportional loading can be achieved, thereby a labor saving for attaching and detaching dies and an automatic bending work can be achieved.

DETAILED DESCRIPTION OF THE PREFERRED EMBODIMENTS

With reference to the appended drawings, a detailed description of the preferred embodiment of the press brake according to the present invention will now be given below.

Figure 1:
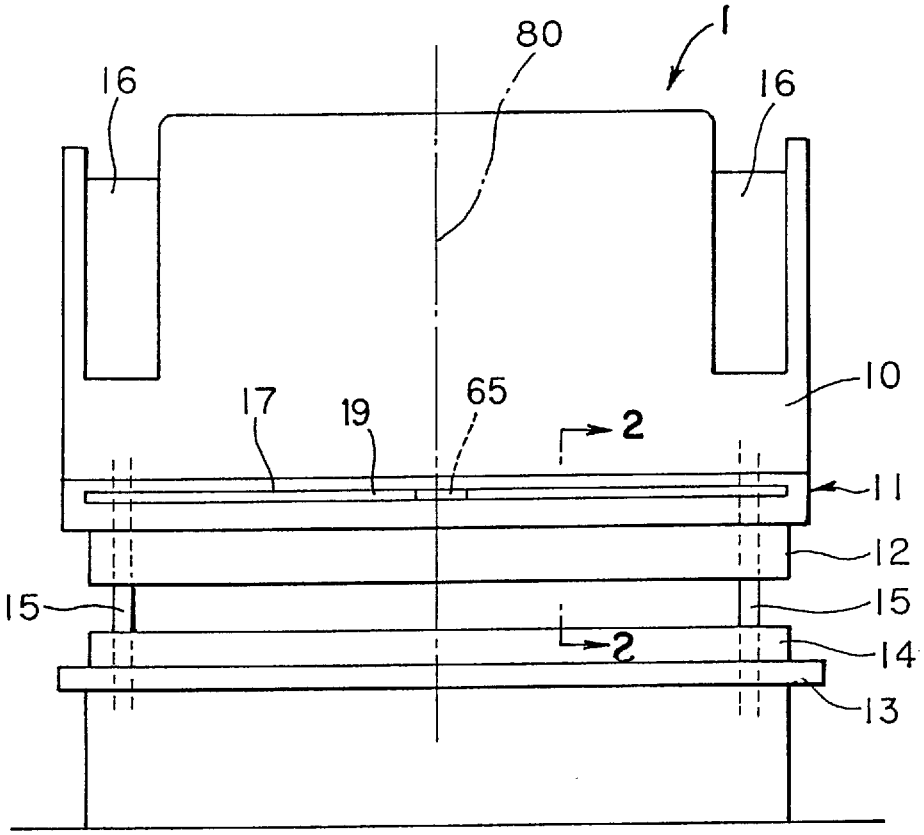
FIG. 1 is a front view of a press brake according to the according to the present invention.
Figure 2:
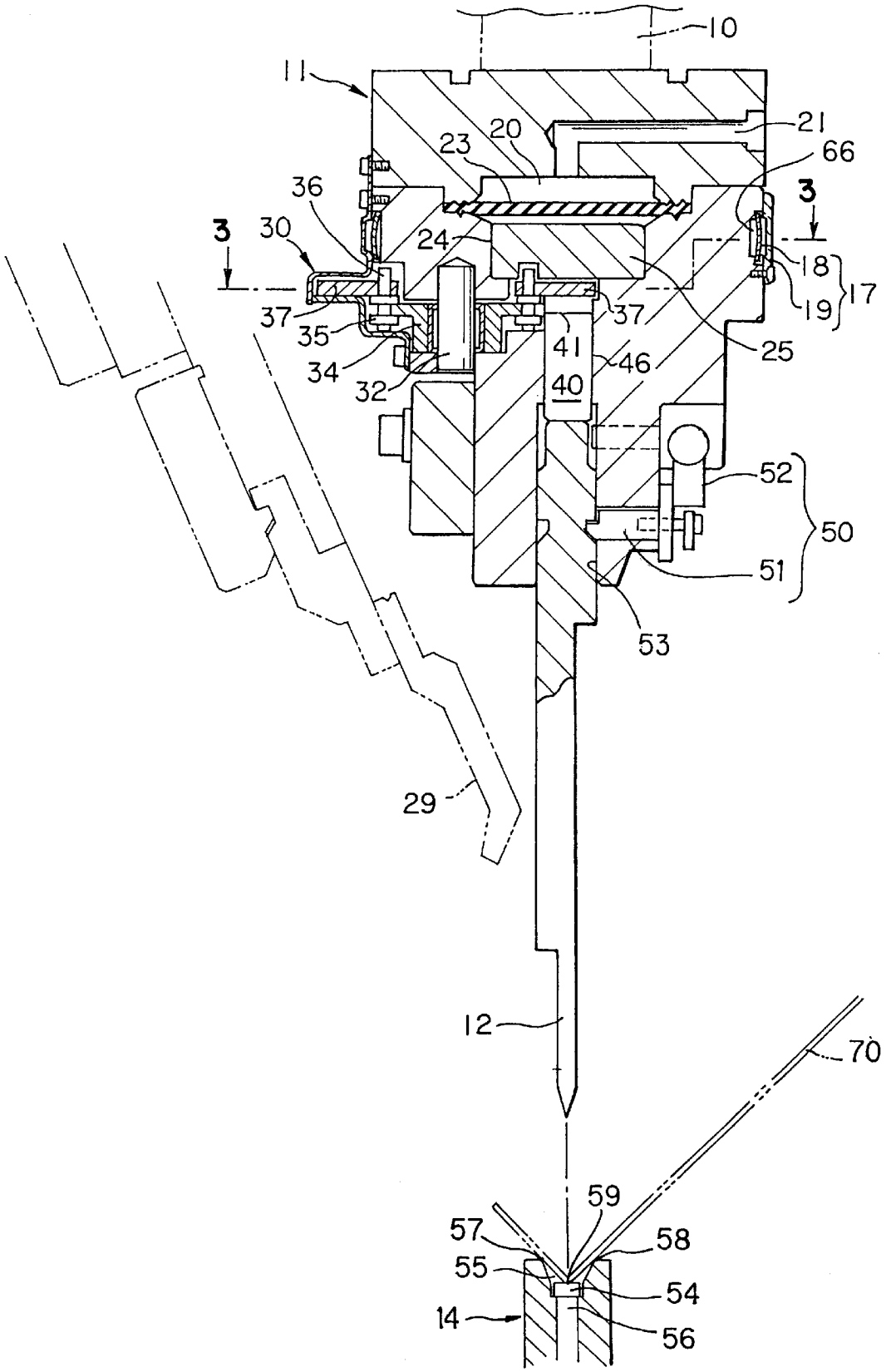
FIG. 2 is an enlarged vertical-section view of the embodiment shown in FIG. 1 which is taken along line A—A thereof.

As illustrated by FIG. 1 and FIG. 2, in the press brake, an upper tool 12 is mounted on a bottom end of a ram 10 via an upper tool holder 11 and is opposite to a lower die 14 provided with a groove on an upper surface of a bed 13. The ram 10 is elevated by an actuation of main cylinders 16, 16 fixed on side frames 15, 15. In the inside of the upper die holder 11, a hydraulic cushion 20 is arranged over full length thereof, a vacant portion 24 which cross section is almost square shape is formed on the lower portion of the hydraulic cushion 20, a thick plate type pressure providing member 25 is arranged in the vacant portion 24 and plurality group of pins (identified by a numeral 40) to be a pressure transmission member are arranged between the pressure providing member 25 and the upper tool 12.

The upper tool 12 having a same length as the ram is mounted in a mounting groove 53 under the holder 11 and is supported by a supporting means 50 having same length of the ram and mounted on a mounting groove 55 at the holder 11 lower portion and the means 50 consists of a clump pawl 51 at the front surface thereof, a foldable lever 52, a fastening pin at the rear surface thereof and a tube (not shown).

As illustrated by FIG. 2, a reverse upper tool 22 is provided. The reversing upper tool 22, as disclosed by Japanese Patent Publication No. Sho 60-29570, is prepared for automatically exchanging a direct-sword type upper tool 12 to a goose neck type upper tool 22 or to an R-bending tool or the like (not shown) and during a use of the direct-sword type upper tool 12, the reverse upper tool is put up to the refuge position by operating the link mechanism as illustrated by a chain line in FIG. 2 and is closely contacted the lower portion of the direct-sword type upper tool 12 in use.

In the illustrated embodiment, one upper tool having an almost same length of the machine width is mounted and a plurality of upper die segments may be mounted (not shown).

The hydraulic cushion 20 consists of a hydraulic chamber 21 formed in the upper die holder 11 and a rubber sheet 23 stretched at the boundary of the hydraulic chamber 21 and the vacant portion 24. As illustrated by FIG. 4, the pressure providing member 25 are arranged in series in the vacant portion 24 and the member which are separated in plural number may be arranged along the longitudinal direction of the vacant portion 24. Furthermore as illustrated by FIG. 2, the lower die 14 includes both shoulders 57, 58 and a lower die bottom member 54 which height can be adjusted. The lower die bottom member 54 is supported by an adjusting member 56 relating to a means for adjusting the height (not shown) such as a wedge in capable of sliding a die length direction. As described hereinafter in accordance with FIG. 3 and FIG. 4, between the lower surface of the pressure providing member 25 and the pin head upper surface, a clearance 48 to receive a spacer 37 is formed and a spacer moving means 30 is provided for orderly inserting the spacer into the selected pin 40 from the machine center line.

Each of elements will be described in detail. At the interior center of the holder 11, it is provided a thin type hydraulic chamber 21 consisting of a hydraulic cushion 20 which is a liquid pressure providing means. A rubber sheet 23 is stretched on the lower surface of the chamber 21 to face the upper surface of the thick sheet type pressure providing member 25. The rubber sheet 23 expands downwardly by supplying a pressurized hydraulic to the chamber 21 and shrinks to be horizontally stretched by releasing the pressure as shown by FIG. 2.

Each pin 40 generally designated by a numeral 40 which is a pressure providing member is inserted between a plurality of holes 46 which are opened at 25 mm pitch distance, for example, at lower portion of a vacant space 24 in the interior of the holder 11 for containing the pressure providing member, and among a group of pins, respective two pins 40*a*, 40*b* at left and right side adjacent to the machine center line 80 are base pins which height is H (40 to 55 mm, for example) from the bottom to the top surface of pin heads 41*a*, 41*b* and the lower surface of the pressure providing member 25 of that portion has no clearance 48. Therefore the top surfaces of pin heads 41*a*, 41*b* do not receive spacers thereinto and contact with a lower surface of a block type pressure supplying member 25 and the height of a plurality of pins 40 arranged outward from said pins 40*a*, 40*b* is designed to be lower in proportion to the spacer thickness t than the base pin height H, thereby a pressure from the pressure providing member 25 is received through spacers inserted in the top surface of pins head 41 and is transmitted to the upper tool 12 at said portion. A notch 44 is formed in the pin head 41*b* to prevent a collision with the spacer 37 which is inserted into the top surface of the pin head 41 (FIG. 3 and FIG. 4).

Figure 3:
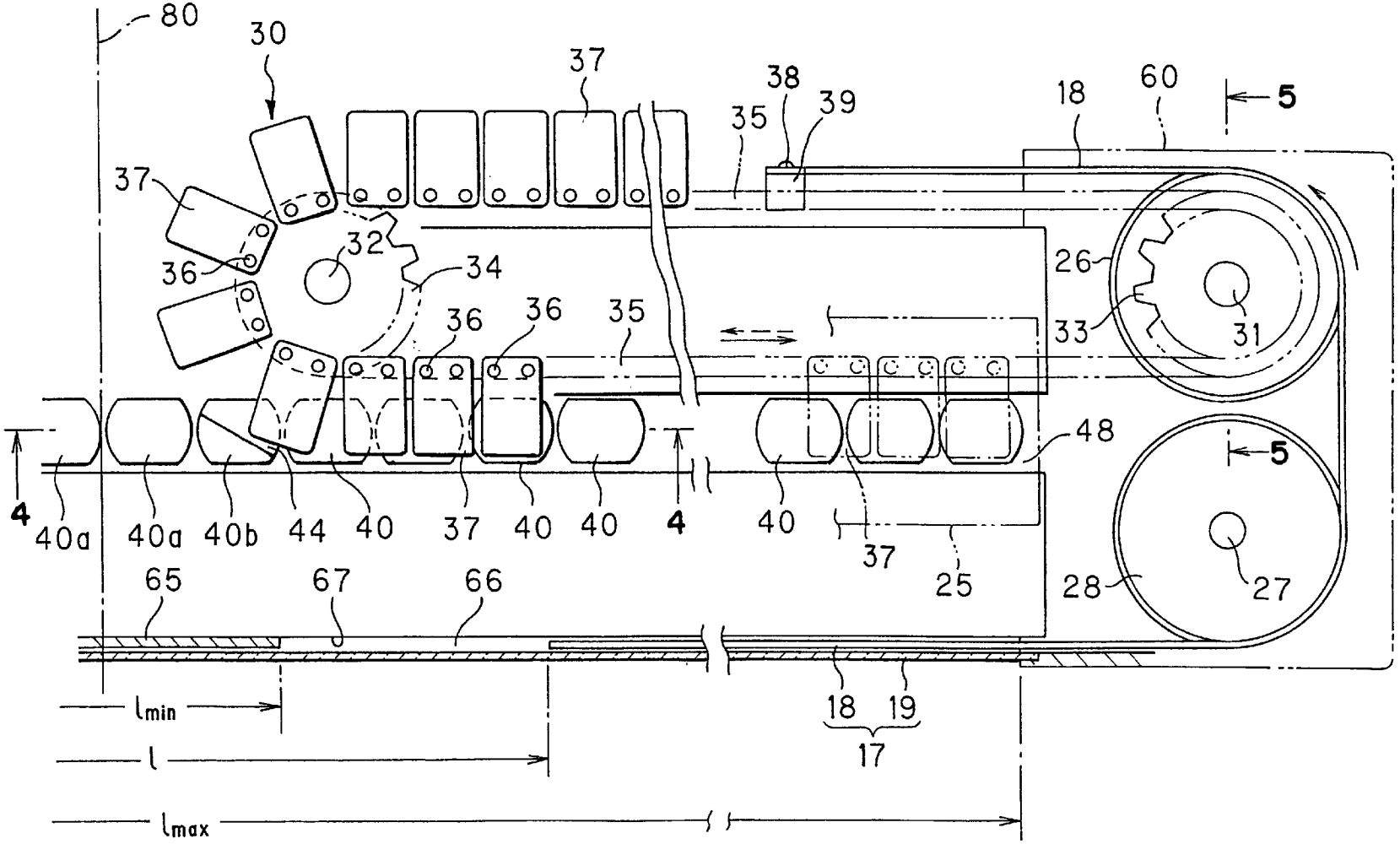
FIG. 3 is an enlarged plane view of the embodiment shown in FIG. 2 which is taken along line B—B thereof.
Figure 4:
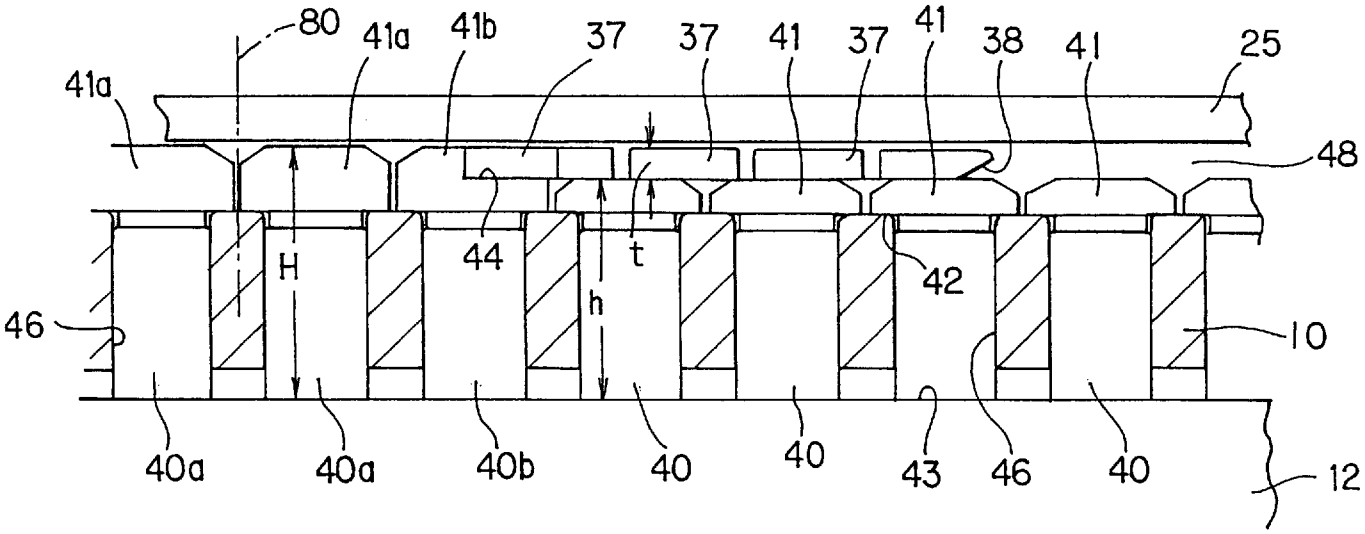
FIG. 4 is an enlarged vertical-section view of the embodiment shown in FIG. 3 which is taken along line C—C thereof.
Figure 5:
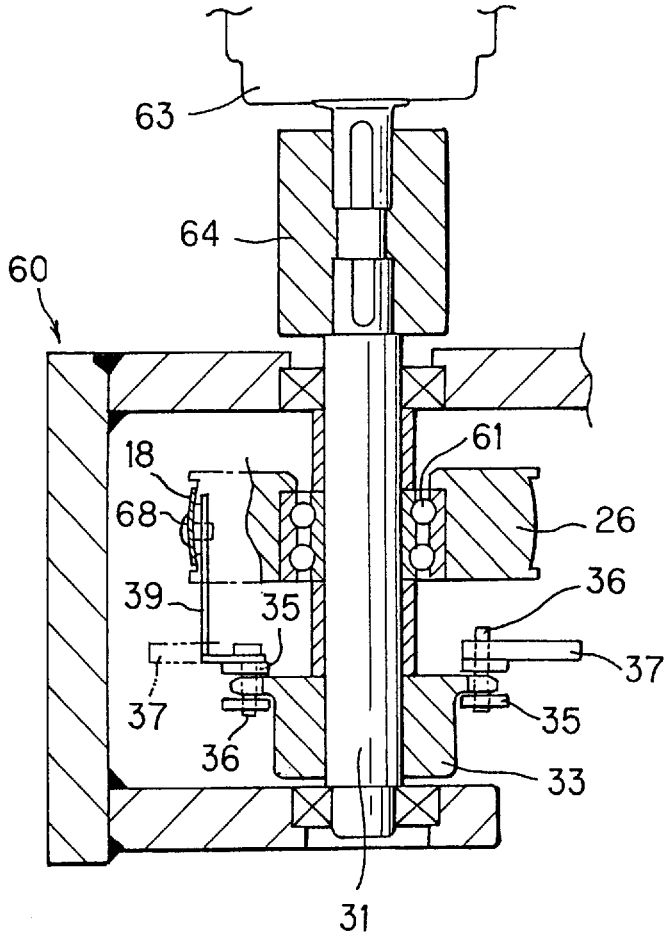
FIG. 5 is an enlarged plane view of the embodiment shown in FIG. 3 which is taken along line D—D thereof.

FIG. 3 illustrates a plane view of a spacer moving means, FIG. 4 illustrates an enlarged section view of the embodiment shown in FIG. 3 which is taken along line C—C thereof and FIG. 5 illustrates a vertical section view of the embodiment shown in FIG. 3 which is taken along line D—D thereof.

Moving means 30 are symmetrically arranged at left and right side of the machine center line so that a necessary number of spacers 37 are inserted in each top portion of pins 40 which are arranged in a longitudinal direction of the pressure providing member 25 for setting the upper tool length to be applied a fluid pressure and said moving means 30 consists of a pair of sprockets 33,34, a pair of endless chains 35 stretched between sprocket 33, 34 to travel in the opposite directions to each other in a horizontal plane of the holder 11 interior side a plurality of spacers 37 mounted by using a link pin of the endless chain 35 and a chain driving motor 63.

Endless chains 35, 35 travel in opposite direction with each other in respect of the machine center line 80 and are driven toward the positive direction to orderly move the spacer 37 from a refuge position of the holder rearward side to left and right clearances 48 along the tool length from the machine center line, while are driven toward reverse direction to orderly pick up the spacer 37 from the clearance 48.

FIG. 3 and FIG. 4 respectively illustrate embodiments that spacers 37, 37 are inserted in upper surface of respective heads 41 of six pins 40 from the third to the fifth pins of left and right side from the machine center line 80. The pins which lower surface diameter is set to be 15 mm , for example, are arranged at 25 mm pitch distance, associated with four base pins 40*a*, 40*b* adjacent to left and right side of the machine center line 80 and six pins 40 which the spacer 37 are inserted thereinto, consequently it is achieved to adjust a total upper tool length of 9 pitches×25 mm=225 mm necessary to be pressurized. When a diameter of the pin lower surface is set to be 15 mm , it is possible to adjust the upper tool length of 225±15 mm. An oblique surface 38 is formed on a front edge of the head spacer 37 (see FIG. 4), thereby the spacer can travel through the clearance 48 without contacting with the pin head and is inserted into the pin head 41 upper surface.

All spacers 37 are inserted in the pin upper surface by driving the chain 35 to achieve a bending process of full machine width (4000 mm for example) at the maximum. While all spacer 37 are set at the refuge position by driving the chain 35 to the reverse direction, thereby a bending process of an effect tool length of 100 mm at minimum is achieved by four base pins 40*a*, 40*a*, 40*b*, 40*b*.

The endless chain 35 is stretched between sprockets 33, 34 respectively mounted on a driving shaft 31 and a following shaft 32 and is actuated by an operation of a numerical control system or the like corresponding to the number of spacers 37 to be inserted. The driving shaft 31 includes a spacer ring 62 and a pulley 26 under the sprocket 33 and which end is provided with a coupling 64 to connect with a reduction mechanism provided motor 63 directly. Furthermore the driving shaft 31 is supported by a box 60 he holder outside(as shown by FIG. 5).

In this embodiment, an upper tool length indicator means 17 is mounted to cooperate with the moving means 30.

The indicator means 17 of the upper tool length consists of an attachment 39 mounted on each chain 35, a pair of indicator bands 18 of which one end is connected with an attachment 39 to indicate the travel of the spacer 37 synchronizing with the travel of the chain 35, a groove 66 formed over full length of the front surface width of the holder 11 for containing the indicator band 18, pulleys 26, 28 to wind the band 18 at the lateral side of the holder 11 and a transparent scale 19 mounted on the front surface of the container groove 66 enable of viewing the travel distance the band 18 corresponding to the upper tool length to be pressurized the uniform fluid pressure by the travel of the spacer 37 (as shown by FIG. 1, FIG. 2, FIG. 3 and FIG. 5).

The indicator band 18 is provided for indicating the upper tool length pressurized a uniform fluid pressure by the travel of the spacer 37 by driving each endless chain 35.

The indicator band 18 is stretched between the pulley 26 mounted on the driving shaft 31 and a pulley 28 of the vertical shaft 27 mounted in front of the driving shaft 31. The pulley 26 is mounted on the driving shaft 31 via a ball bearing 61, the pulley 28 of the vertical shaft 27 is also supported by the ball bearing (not shown) and travels synchronizing with the movement of the attachment 39 mounted on the chain. The rear end of the band 18 is fixed on the attachment 39 of the chain 35 and the forward end side thereof to be wound and guided by the pulley 26, 28 is inserted into the band container groove 66. The transparent scale 19 is mounted on the front surface of the band container groove 66 to view the indicator band 18 therethrough.

A base plate 65 is fixed on the center portion of the longitudinal direction of the band container groove 66 to indicate the minimum upper tool length (1 min), the front surface of the indicator band 18 inserted in the band container groove 66 is colored the same color of the base plate 65 white color for example) and at least vertical wall 67 of the band container groove is colored in an opposite color or in a different color density with the base plate.

The band travels in the band container groove synchronizing with controlling the number of spacers 37 to be inserted so that the distance between both ends of the indicator band 18, 18 means an effect upper tool length from the minimum upper tool length (1 min ) to the maximum upper tool length (1 max), and said length can be read through the transparent scale 19 from outside.

Using the machine described above, the bending process for a rectangular sheet panel having the long side=725 mm, the short side=475 mm and each side rising=15 mm will be explained.

Prospecting each side rising, the work sheet 70 in form of the long side of 725+(15×2)=755 mm and the short edge side of 475+(15×2)=505 mm has a square shape notch of 15 mm each side at the corner portion in order to avoid an interference with the rising.

Prior to the bending work, the machine center line 80 and a center line of the work sheet is adjusted by a centering device (not shown) to set the edge bending length by a back gauge.

For bending the edge of the short side, every eight spacers 37 are inserted in each pin 40 upper portion by actuating the driving sprocket 33 to travel the chain 35 and the necessary upper tool length of 475 mm for short side pressure is adjusted so as to be 19 pitches×25 mm in associate with each space length of pins 40*a*, 40*b* adjacent to left and right side of the machine center line 80. The traveling distance of the indicator band 18 is checked via the transparent scale 19 in front of the machine. Thereafter one edge of the short side is bent by pressing down the ram and the other edge of the short side is bent by a rotation of 180° of the work sheet 70. In pressing the upper tool 12 by pressing down the ram 10, the bending angle is determined by three points of shoulder portions 57, 58 of the lower tool and height adjustable top surface 59 of the lower tool bottom member 54 to bend the work sheet 70 in a condition that the uniform fluid pressure is provided to the die in process by an operation of main cylinders 16, 16.

Furthermore the work sheet is turned 90° in a horizontal surface for centering the long side of the work sheet, thereafter every fourteen spacers 37 are inserted in left and right side by driving the driving sprocket 33 and the necessary upper tool length of 725 mm for bending the edge of the long side is adjusted so as to be 29 pitches×25 mm in associate with each space length of pins 40*a*, 40*b* adjacent to left and right side of the machine center line 80. As same as described hereinbefore, after checking the traveling distance of the indicator band 18 through the transparent window 19, one edge of the long side is bent, further other edge of the long side is bent by turning the work sheet 70 in 180°. The bending process of the rectangular panel sheet such that long and short sides are bent to stand up is completed by the steps described above.

As described above, in a press brake of a bending machine in accordance with the present invention, an effect upper tool length can be changed automatically in according to the bending length of the work sheet without distinction of upper tool constructions such as a single and uniform upper tool for a full length of the machine width or a combination of split upper tools, thereby it is possible to achieve an efficient bending work for various length work sheet with preventing unequal bending. Furthermore determined number of spacers which is a supplemental pressure transmission member are merely inserted orderly in the upper surface of pin line at the selected position from the machine center line among pressure transmission pins mounted between the pressure providing member and the upper tool, thereby the distance of the width direction of the upper tool line to be transmitted the pressurized force (effect length of upper tool) from the pressure providing member can be optionally set.

Furthermore in the press brake according to the present invention, an effective length of the tool which are arranged at left and right side of the press machine center line can be selected freely, corresponding to the different width of long and short edge side of the work sheet, a free selecting possibility of the tool in preventing a disproportional load thereon is increased to bend the work sheet at the press brake center line, thereby a labor saving for attaching and detaching of tools and an automatic bending work can be achieved. Furthermore a speedy exchanging of tools and a labor saving therefor can be achieved.

For precise bending process of the stainless steel sheet, it is necessary to remove a slight irregular portion which appears along the boundary line of the split upper tool by an next process, however, in accordance with the press brake of the present invention, there appears no irregular portion on the bending line to be removed by the next process, and a precise bending process can be achieved.

10: ram 11: holder 12: upper tool 13: bed 14: lower die 15: side frame 16: main cylinder 17: means for indicating upper die length 18: indicator band 19: transparent scale 20: hydraulic cushion 21: hydraulic chamber 22: hydraulic passageway 23: rubber sheet 24: vacant portion 25: block (pressure providing member) 26, 28: pulley 27: vertical shaft 29: reverse upper die 30: spacer moving means 31: driving shaft 32: follow shaft 33: driving sprocket 34: follow sprocket 35: endless chain 36: link pin 37: spacer 38: oblique surface 39: attachment 40, 40*a*, 40*b*: pin (pressure transmission member) 41, 41*a*, 41*b*: head of pin 42: shoulder of pin head 43: lower surface of pin 44: notch 46: hole for receiving pins 48: clearance for receiving the spacer 50: upper tool supporting means 51: clamp pawl 52: foldable lever 53: upper die mounting groove 54: lower die bottom member 55: lower die groove 56: adjusting member 57, 58: both shoulders of lower die 59: top portion of lower die bottom member 60: box 61: ball bearing 62: spacer ring 63: motor 64: coupling 65: base plate 66: band container groove 67: vertical wall of band container groove 68: screw 70: work sheet 80: machine center line H: height of base pins 40*a*, 40*b* h: height of pin 40 t: thickness of spacer

We claim:

1. A press brake for bending a work sheet comprising:

a ram (10), an upper tool holder (11) mounted on a bottom end of the ram, a hydraulic cushion (20) formed by a hydraulic chamber (21) and a diaphragm (23) closing the bottom of said chamber, extending along the length of the upper tool holder, a press block (25) mounted below and adjacent said hydraulic cushion, an upper tool (12) mounted on a lower portion of the upper tool holder, a bed (13) and a lower tool (14) having spaced shoulders (57, 58) and a height adjustable lower tool bottom member (54);

the upper tool holder including:

a plurality of pressure transmission pins (40*a* 40*b*,40) symmetrically mounted on either side of a mechanical center line (80) between the press block and the upper tool, at least one of said pins 40*a* and 40*b* on each side of said center line being base pins, and the rest of the pins (40) outboard of said base pins being shorter than said base pins;

a clearance (48) formed between a lower surface of the press block and an upper surface of said shorter pressure transmission pins, a series of spacers (37) carried by a spacer chain (35) for insertion into the clearance, and spacer chain moving means (30) capable of orderly inserting a predetermined number of spacers in the clearance above the upper surface of predetermined numbers of said shorter pressure transmission pins 40 at a selected position from the mechanical center line for making an effective length of the upper tool correspond with the bending length of the work sheet.

2. A press brake for bending a work sheet according to claim 1, the upper tool holder 11 further comprising a cavity 24 to contain the press block 25, a plurality of open-ended passages 46 below the cavity for receiving the pressure transmission pins and two spacer chains 35, 35 on which said spacers 37 are mounted and two chain moving means, said chains and chain moving means being positioned symmetrically on opposite sides of the mechanical center line.

3. A press brake for bending a work sheet according to claim 2 wherein the endless chains 35, 35 travel in opposite directions with respect to each other from the mechanical center line 80 for orderly moving the spacers 37 from a position outside the clearances into respective clearances left and right from the mechanical center line by actuation of said chains in one direction and for moving the spacers 37 out from the clearance 48 by actuation in a reverse direction.

4. A press brake for bending a work sheet according to claim 1 further comprising means 17 for indicating the upper tool length, said means including an attachment 39 mounted on at least one of chains 35, and an indicator band 18 one end of which is connected to the chain by the attachment 39 for indicating the movement of the spacers 37 synchronizing with the movement of the chain 35, a groove 66 formed along the length of a front surface of the holder 11 for containing the indicator band 18 and a transparent scale 19 overlying said groove to permit viewing the movement of the band 18, said movement corresponding to the length of the upper tool subject to a uniform fluid pressure.

5. A press brake for bending a work sheet according to claim 4 characterized in that the means 17 for indicating the upper tool length comprises a pair of left and right pulleys 26, 28 mounted at the side of the band container groove, a pair of left and right side indicator bands 18 for indicating the length of the upper tool subject to uniform fluid pressure from a minimum upper tool length (1 min.) to a maximum upper tool length (1 max.).

6. A press brake for bending a work sheet according to claim 4 characterized in that a colored base plate 65 is fixed on a center portion of a longitudinal direction of the band container groove 66 for indicating the minimum upper tool length (1 min.), a front surface of the indicator band 18 inserted into the band container groove 66 being colored in a same color of the base plate 65 and at least a vertical wall 67 of the band container groove being colored differently from the base plate.

7. In a press brake for bending a work sheet, said brake having a ram, an upper tool holder mounted on a bottom end of the ram, the upper tool holder having a center line midway of its length, a press block mounted in said upper tool holder, and upper tool means mounted on a lower portion of the upper tool holder below said press block, the improvement comprising a plurality of pressure transmission pins symmetrically mounted on either side of said mechanical center line between the press block and said upper tool means, at least one of said pins adjacent each side of said center line being a base pin, and the pins outboard of said base pins being shorter than said base pins; a clearance between a lower surface of the press block and an upper surface of said shorter pressure transmission pins, spacer chains mounted at opposite sides of said center line, a series of spacers carried by said spacer chains for insertion into the clearance, and spacer chain moving means operable for inserting a predetermined number of spacers in the clearance above the upper surface of said shorter pressure transmission pins at selected positions, beginning from the shorter pins closest to the mechanical center line, for making an effective length of the upper tool means, symmetrically about said center line, correspond with a bending length of the work sheet.

8. The improvement of claim 7 including indicator means visible from the front of said brake, for indicating the position of said spacers with respect to said shorter pins.

9. The improvement of claim 7 wherein said spacer chain moving means comprises drive sprockets and idler sprockets around which said spacer chains extend, and motor means for selectively driving said drive sprockets through discrete, predetermined distances.

10. The improvement of claim 7 wherein said drive sprockets on opposite side of said center line rotate in opposite directions.

11. The improvement of claim 7 including a bed (13) and a lower tool (14) mounted on said bed, said lower tool having parallel shoulders (57, 58) and a height-adjustable lower tool bottom member (54), said lower tool being vertically aligned with said upper tool.

* * * * *

UNITED STATES PATENT AND TRADEMARK OFFICE

CERTIFICATE OF CORRECTION

PATENT NO. : 5,813,273
DATED : September 29, 1998
INVENTOR(S) : Toshio Hongo

It is certified that error appears in the above-identified patent and that said Letters Patent is hereby corrected as shown below:

Please delete all text beginning at Column 1, line 1 through column 9, line 47 and replace the text with the attached specification.

Signed and Sealed this

Twenty-third Day of April, 2002

*Attest:*

*Attesting Officer*

JAMES E. ROGAN
*Director of the United States Patent and Trademark Office*

BACKGROUND OF THE INVENTION

The present invention relates to a press brake, and in particular, relates to a press brake for bending a work sheet wherein a chosen effective length of an upper tool (upper die) to which pressure is to be transmitted from a ram can be set from a machine center line and the upper tool portion other than the chosen length can be prevented from receiving a transmission of the pressure from the ram. In Japanese application number 02410072, publication number 04210821, published July 31, 1992, a press brake is illustrated in which spacers on plungers above split dies are selectively removed by withdrawing the plungers manually, to free selected reaches of split dies from pressure from the ram. The present invention has to do with an improvement on that press brake.

BRIEF SUMMARY OF THE INVENTION

In accordance with this invention, generally stated, in a press brake for bending a work sheet, in which an upper tool is mounted in an upper tool holder at the lower end of a ram, pins, serving as pressure transmission members, are arranged symmetrically on opposite sides of a machine center line 80 of the upper tool holder 11. An elongated press block 25, spaced from the pins above the pins, transmits pressure to those pins with which it comes into contact in the forming operation. A hydraulic cushion 20 above the press block includes a chamber 21 and a rubber sheet 23. The cushion arrangement is known in the art and forms no part of the present invention. Pins 40a and 40b, adjacent the center line, are of a height to be engaged by the press block in any event, their positioning accommodating a work piece of minimum width. A larger space exists above pins 40, which are positioned outboard, with respect to the center line, of the pins 40a and 40b. Spacers 37 are mounted on a mechanism 30 by which they can be moved selectively and automatically into and out from the space between the press block member 25 and any selected number of the pins 40 outboard of the pins 40a and 40b adjacent the center line. The mechanism shown in Figure 4 has a mirror image counterpart on the other side of the machine centerline. The effective length of the upper tool can thus be changed automatically to correspond to the bending length of the work sheet.

The spacer moving mechanism 30 comprises two pairs of sprockets 33, 34 symmetrically arranged left and right of the mechanical center line 80, each pair of sprockets having an endless chain 36 stretched between them. Each of the chains 36 carries a plurality of spacers. Each pair of sprockets has a motor connected to it for driving the chain. The endless chains 35, 35 travel in opposite directions from the mechanical center line 80 to move the spacers from a position at which they are clear of the pins, at the rear of the holder, into respective clearances 48 left and right from the mechanical center line. The movement of the chains, hence the spacers, is controlled by an actuator, driving the chains in one direction to move spacers into the desired position in the space 48 over the predetermined number of pins, and in the reverse direction, to remove the spacers 37, or as many as is desired, from the space 48.

The press brake according to the present invention further includes a means 17 for indicating the upper tool length, comprising a pair of left and right pulleys 26, 28 mounted on left and right shafts 31 of the chain driving sprockets, and, indicator bands 18 mounted in band container grooves in the upper tool holder. The bands are connected at one end to the chains, and at the other end, are inserted into a band container groove, for indicating the position of the spacers with respect to the pins by means of a transparent scale 19 mounted over the front surface of the band container groove 66 for viewing the indicator band 18.

A colored base plate 65 is fixed on a center portion of the band container groove 66 for indicating the minimum upper tool length (1 min.), a front surface of the indicator band 18 in the band container groove 66 is colored the same color as the base plate 65 and a vertical wall 67 of the band container groove is colored in an opposite color or in a different color density from the base plate.

Corresponding to the bending length of the work sheet, the drive sprocket is actuated to move the endless chain so as to adjust the effective length of the upper tool by inserting a predetermined number of spacers into the space above the upper surface of the pressure transmission pins in the direction outboard from the machine center line. The travel distance of the indicator band is checked through the transparent scale mounted at the machine front surface.

A bending angle of a work sheet is determined by three points or lines established by two spaced shoulders of a lower tool and a lower tool bottom, the height of which can be adjusted.

BRIEF DESCRIPTION OF THE SEVERAL VIEWS OF THE DRAWINGS

In the drawings, Figure 1 is a front view of a press brake according to the present invention;

Figure 2 is an enlarged sectional view, taken along the line 2-2 of Fig. 1;

Figure 3 is an enlarged plan view, partly in section, taken along line 3-3 of Fig. 2;

Figure 4 is a sectional view taken along line 4-4 of Fig. 3; and

Figure 5 is an enlarged sectional view taken along line 5-5 of Fig. 3.

Corresponding reference numerals will be used throughout the several figures of the drawings.

DETAILED DESCRIPTION OF THE INVENTION

Referring to Figures 1 and 2, a press brake 1 has an upper tool holder 11 mounted on a bottom end of a ram 10 and an upper tool 12 mounted in the tool holder 11. The tool 12 is oriented in line with and above a lower die 14 mounted on an upper surface of a bed 13.

The ram 10 is reciprocated vertically by the operation of main cylinders 16, 16 fixed on side frames 15, 15. Inside the upper die holder 11, a hydraulic cushion 20 is arranged over the full working length thereof. An elongated press block 25, running along the length of the holder 11, is seated against a step around an opening in the bottom of an open-topped cavity 24 below the hydraulic cushion 20. Pins 40a, 40b, and 40 are mounted in passages 26 between the press block 25 and the upper tool 12 to serve as pressure transmission members. Each of the pins has a head 41 extending outboard of the upper open end of the passage in which the pin is mounted.

As shown particularly in Figure 2, the upper tool 12 is mounted in a channel 53 in a lower section of the holder 11 and is supported by supporting means 50. The means 50 includes a pawl 51 with a beveled nose that is spring biased into a complementarily shaped notch in the tool, a lever 52, and a fastening pin. The tool 12 itself and the mounting and supporting means are conventional and form no part of this invention.

In Fig. 2, a reversing upper tool 29 is shown in phantom lines. Such a reversing upper tool 29 is disclosed in Japanese Patent Publication No. Sho 60-29570, and provides for automatically replacing a direct-sword type upper tool 12 with a goose neck type upper tool 29 or with an R-bending tool or the like (not shown).

As shown particularly in Figure 2, the hydraulic cushion 20 includes a hydraulic chamber 21 formed in the upper die holder 11 and a heavy rubber diaphragm 23 mounted to close the lower end of the hydraulic chamber 21 and the upper open end of the cavity 24.

As illustrated by Fig. 2, the lower die 14 includes spaced shoulders 57, 58 and a lower die bottom member 54 the height of which can be adjusted. The lower die bottom member 54 is supported by an adjusting member 56 relating to a means for adjusting the height (not shown) such as a wedge or screw.

As described hereinafter in accordance with Fig. 3 and Fig. 4, between the lower surface of the press block 25 and the pin head upper surface, there is a clearance or space 48 to receive a spacer 37 and a spacer moving means 30 is provided for inserting spacers in that space between the press block and one or more selected pins 40 in a direction outboard from the machine center line.

The hydraulic cushion 20 rubber diaphragm 23 expands downwardly in response to the supplying of pressurized hydraulic fluid to the chamber 21 from a source, not here shown, and engages the top of the press block 25, and, when the pressure is released, shrinks to be horizontally stretched as is shown in Fig. 2.

Two pins 40a, 40b on either side of the machine center line 80 are base pins of a height H (40 to 55mm, for example) from the bottom to the top surface of pin heads 41a, 41b to engage the press block 25 when the hydraulic cushion is pressurized. Therefore, between the lower surface of the press block 25 and those heads, there is only enough clearance to permit the insertion of the spacers into the space 48 above the pins 40 outboard of the pins 40b when the hydraulic cushion is relaxed. The pins 40 are arranged in a line outboardly from the pins 40a, 40b. The height of the pins 40 is lower than the base pin height H so that pressure from the press block 25 is received by the pins 40 through the spacers inserted over the top surface of pin heads 41 and is transmitted to the upper tool 12. A notch 44 is formed in the pin head 41b to permit the passage of the spacers 37 as they are inserted into and removed from the space 48 above the top surface of the pin heads 41 (Fig. 3 and Fig. 4).

Mirror image moving means 30 are symmetrically arranged at the left and right sides of the machine center line. Each of the moving means 30 consists of spaced sprockets 33 and 34, and an endless chain 35 extending between sprockets 33 and 34. In order to introduce the spacers 37 from a position next to the center line to a position outboardly of the pins 40a and 40b on both sides of the center line it is necessary for the chains 35 to travel in opposite directions from one another. The spacers 37 are mounted on the chain by using a link pin of the endless chain 35. The sprocket 33 is a drive sprocket and is driven by a motor 63 connected to a sprocket shaft 31. The sprocket 34 is an idler sprocket.

In the illustrative embodiment shown in Figures 3 and 4, spacers 37, 37 are shown inserted in the space above the upper surface of heads 41 of six pins 40, from the third to the fifth pins on the left and right sides from the machine center line 80. An oblique surface 38 is formed on a front edge of the head spacer 37 (see Fig. 4), whereby the leading edge of the spacer can travel through the clearance 48 without contacting the pin head .

When all spacers 37 are inserted in the pin upper surface by driving the chain 35, the maximum width to be accomplished in the bending process (4000mm for example) is achieved.

When all spacers 37 are fully retracted by driving the chain 35 in the reverse direction, the minimum width to be accomplished in the bending process (100mm for example) is achieved by the four base pins 40a, 40a, 40b, 40b.

The endless chain 35 stretched between sprockets 33 and 34, respectively mounted on the driving shaft 31 and a following shaft 32, is actuated by operation of a numerical control system or the like to insert or remove the desired number of spacers 37. The driving shaft 31 has a coupling 64 at its upper end to connect with the motor 63 directly or through a reduction mechanism The shaft has keyed to it the sprocket 33 and, under the sprocket 33, a pulley 26. The driving shaft 31 and a pulley shaft 27 are supported by a box 60 mounted on the side frame 15 (as shown in Figs. 3 and 5).

In this embodiment, a spacer positioning indicator means 17 is mounted to cooperate with the moving means 30. The indicator means 17 is made up of an attachment 39 mounted on each chain 35, a pair of indicator bands 18, one end of each of which is connected with the attachment 39 to indicate the travel of the chain 35, a groove 66 formed over the full length of the front surface width of the holder 11 for containing the indicator band, pulleys 26 and 28 to wind the band 18 at the lateral side of the holder 11 and a transparent scale 19 mounted on the front surface of the groove 66 to enable an operator to view the travel distance of the band 18. Knowing the position of the attachment on the chain, hence of the spacers 37, permits the operator to determine immediately the upper tool length which will be pressurized by the uniform fluid pressure of the cushion (as shown by Fig. 1, Fig. 2, Fig. 3 and Fig. 5).

The indicator band 18 is stretched between the pulley 26 mounted on the driving shaft 31 and a pulley 28 mounted on vertical shaft 27, positioned in front of the driving shaft 31. The pulley 26 is mounted on the driving shaft 31 via a ball bearing 61, the pulley 28 on the vertical shaft 27 is also supported by the ball bearing (not shown) and travels synchronized with the movement of the attachment 39 mounted on the chain. The rear end of the band 18 is fixed on the attachment 39 of the chain 35 and the forward end, wound and guided by the pulleys 26 and 28, is inserted into the band container groove 66. The transparent scale 19 is mounted on the front surface of the band container groove 66 to view the indicator band 18 therethrough.

A base plate 65 is fixed on the center portion of the longitudinal direction of the band container groove 66 to indicate the minimum upper tool length (1 min.), the front surface of the indicator band 18 inserted in the band container groove 66 is colored the same color as the base plate 65 (white color for example) and at least a vertical wall 67 of the band container groove is colored in an opposite color or in a different color density from the base plate.

Using the machine described above, the bending process to produce a rectangular pan 70 having a long side of 725mm, a short side of 475mm and each side rising 15mm will be explained.

Assuming that each side is to be bent up, a work sheet 70 with a long edge side of 755mm and a short edge side of 505mm has a square shape notch of 15mm each side at the corner portion in order to avoid interference of the meeting corners. Prior to bending the sheet, the machine center line 80 and a center line of the work sheet are adjusted by a centering device (not shown) to set the edge bending length by a back gauge. In this example, for the edge of the short side, eight spacers 37, four on each side, are inserted by actuating the driving sprockets 33 to move the chains 35. The traveling distance of the indicator band 18 is checked via the transparent scale 19 in front of the machine. Thereafter one edge of the short side is bent by pressing down the ram and the other edge of the short side is bent by rotating the work sheet 180°. The bending angle is determined by three points of shoulder portions 57, 58 of the lower tool and height adjustable top surface 59 of the lower tool bottom member 54.

Then the work sheet is turned 90° for centering the long side of the work sheet, fourteen spacers 37 are inserted by driving the driving sprockets 33. As described above, after checking the traveling distance of the indicator band 18 through the transparent window 19, one edge of the long side is bent, and then the other edge of the long side is bent by turning the work sheet 180°.

As described above, in a press brake of a bending machine in accordance with the present invention, an effective upper tool length can be changed automatically in accordance with the bending length of the work sheet.

The press brake according to the present invention prevents a disproportionate load by bending the work sheet symmetrically about the press brake center line automatically both when the central pins are employed alone, and when the spacers are inserted.

For precise bending of a stainless steel sheet, heretofore it has been necessary to remove a slight irregular portion which appears along the boundary line of the split upper tool by a subsequent process; however, in accordance with the press brake of the present invention, there appears no irregular portion on the bending line to be removed, and a precise bending process can be achieved.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

UNITED STATES PATENT AND TRADEMARK OFFICE

CERTIFICATE OF CORRECTION

PATENT NO. : 5,813,273
DATED : September 29, 1998
INVENTOR(S) : Toshio Hongo

It is certified that error appears in the above-identified patent and that said Letters Patent is hereby corrected as shown below:

Please delete all text beginning at Column 1, line 1 through column 12, and replace the text with the attached substitute specification columns 1-8.

This certificate supersedes Certificate of Correction issued April 23, 2002.

Signed and Sealed this

Thirtieth Day of March, 2004

JON W. DUDAS
*Acting Director of the United States Patent and Trademark Office*

PRESS BRAKE

BACKGROUND OF THE INVENTION

The present invention relates to a press brake, and in particular, relates to a press brake for bending a work sheet wherein a chosen effective length of an upper tool (upper die) to which pressure is to be transmitted from a ram can be set from a machine center line and the upper tool portion other than the chosen length can be prevented from receiving a transmission of the pressure from the ram. In Japanese application number 02410072, publication number 04210821, published Jul. 31, 1992, a press brake is illustrated in which spacers on plungers above split dies are selectively removed by withdrawing the plungers manually, to free selected reaches of split dies from pressure from the ram. The present invention has to do with an improvement on that press brake.

BRIEF SUMMARY OF THE INVENTION

In accordance with this invention, generally stated, in a press brake for bending a work sheet, in which an upper tool is mounted in an upper tool holder at the lower end of a ram, pins, serving as pressure transmission members, are arranged symmetrically on opposite sides of a machine center line 80 of the upper tool holder 11. An elongated press block 25, spaced from the pins above the pins, transmits pressure to those pins with which it comes into contact in the forming operation. A hydraulic cushion 20 above the press block includes a chamber 21 and a rubber sheet 23. The cushion arrangement is known in the art and forms no part of the present invention. Pins 40*a* and 40*b*, adjacent the center line, are of a height to be engaged by the press block in any event, their positioning accommodating a work piece of minimum width. A larger space exists above pins 40, which are positioned outboard, with respect to the center line, of the pins 40*a* and 40*b*. Spacers 37 are mounted on a mechanism 30 by which they can be moved selectively and automatically into and out from the space between the press block member 25 and any selected number of the pins 40 outboard of the pins 40*a* and 40*b* adjacent the center line. The mechanism shown in FIG. 4 has a mirror image counterpart on the other side of the machine centerline. The effective length of the upper tool can thus be changed automatically to correspond to the bending length of the work sheet.

The spacer moving mechanism 30 comprises two pairs of sprockets 33, 34 symmetrically arranged left and right of the mechanical center line 80, each pair of sprockets having an endless chain 36 stretched between them. Each of the chains 36 carries a plurality of spacers. Each pair of sprockets has a motor connected to it for driving the chain. The endless chains 35, 35 travel in opposite directions from the mechanical center line 80 to move the spacers from a position at which they are clear of the pins, at the rear of the holder, into respective clearances 48 left and right from the mechanical center line. The movement of the chains, hence the spacers, is controlled by an actuator, driving the chains in one direction to move spacers into the desired position in the space 48 over the predetermined number of pins, and in the reverse direction, to remove the spacers 37, or as many as is desired, from the space 48.

The press brake according to the present invention further includes a means 17 for indicating the upper tool length, comprising a pair of left and right pulleys 26, 28 mounted on left and right shafts 31 of the chain driving sprockets, and, indicator bands 18 mounted in band container grooves in the upper tool holder. The bands are connected at one end to the chains, and at the other end, are inserted into a band container groove, for indicating the position of the spacers with respect to the pins by means of a transparent scale 19 mounted over the front surface of the band container groove 66 for viewing the indicator band 18.

A colored base plate 65 is fixed on a center portion of the band container groove 66 for indicating the minimum upper tool length (1 min.), a front surface of the indicator band 18 in the band container groove 66 is colored the same color as the base plate 65 and a vertical wall 67 of the band container groove is colored in an opposite color or in a different color density from the base plate.

Corresponding to the bending length of the work sheet, the drive sprocket is actuated to move the endless chain so as to adjust the effective length of the upper tool by inserting a predetermined number of spacers into the space above the upper surface of the pressure transmission pins in the direction outboard from the machine center line. The travel distance of the indicator band is checked through the transparent scale mounted at the machine front surface.

A bending angle of a work sheet is determined by three points or lines established by two spaced shoulders of a lower tool and a lower tool bottom, the height of which can be adjusted.

BRIEF DESCRIPTION OF THE SEVERAL VIEWS OF THE DRAWINGS

In the drawings, FIG. 1 is a front view of a press brake according to the present invention;

FIG. 2 is an enlarged sectional view, taken along the line 2—2 of FIG. 1;

FIG. 3 is an enlarged plan view, partly in section, taken along line 3—3 of FIG. 2;

FIG. 4 is a sectional view taken along line 4—4 of FIG. 3; and

FIG. 5 is an enlarged sectional view taken along line 5—5 of FIG. 3.

Corresponding reference numerals will be used throughout the several figures of the drawings.

DETAILED DESCRIPTION OF THE INVENTION

Referring to FIGS. 1 and 2, a press brake 1 has an upper tool holder 11 mounted on a bottom end of a ram 10 and an upper tool 12 mounted in the tool holder 11. The tool 12 is oriented in line with and above a lower die 14 mounted on an upper surface of a bed 13.

The ram 10 is reciprocated vertically by the operation of main cylinders 16, 16 fixed on side frames 15, 15. Inside the upper die holder 11, a hydraulic cushion 20 is arranged over the full working length thereof. An elongated press block 25, running along the length of the holder 11, is seated against a step around an opening in the bottom of an open-topped cavity 24 below the hydraulic cushion 20. Pins 40*a*, 40*b*, and 40 are mounted in passages 26 between the press block 25 and the upper tool 12 to serve as pressure transmission members. Each of the pins has a head 41 extending outboard of the upper open end of the passage in which the pin is mounted.

As shown particularly in FIG. 2, the upper tool 12 is mounted in a channel 53 in a lower section of the holder 11 and is supported by supporting means 50. The means 50 includes a pawl 51 with a beveled nose that is spring biased into a complementarily shaped notch in the tool, a lever 52, and a fastening pin. The tool 12 itself and the mounting and supporting means are conventional and form no part of this invention.

In FIG. 2, a reversing upper tool 29 is shown in phantom lines. Such a reversing upper tool 29 is disclosed in Japanese Patent Publication No. Sho 60-29570, and provides for automatically replacing a direct-sword type upper tool 12 with a goose neck type upper tool 29 or with an R-bending tool or the like (not shown).

As shown particularly in FIG. 2, the hydraulic cushion 20 includes a hydraulic chamber 21 formed in the upper die holder 11 and a heavy rubber diaphragm 23 mounted to close the lower end of the hydraulic chamber 21 and the upper open end of the cavity 24.

As illustrated by FIG. 2, the lower die 14 includes spaced shoulders 57, 58 and a lower die bottom member 54 the height of which can be adjusted. The lower die bottom member 54 is supported by an adjusting member 56 relating to a means for adjusting the height (not shown) such as a wedge or screw.

As described hereinafter in accordance with FIG. 3 and FIG. 4, between the lower surface of the press block 25 and the pin head upper surface, there is a clearance or space 48 to receive a spacer 37 and a spacer moving means 30 is provided for inserting spacers in that space between the press block and one or more selected pins 40 in a direction outboard from the machine center line.

The hydraulic cushion 20 rubber diaphragm 23 expands downwardly in response to the supplying of pressurized hydraulic fluid to the chamber 21 from a source, not here shown, and engages the top of the press block 25, and, when the pressure is released, shrinks to be horizontally stretched as is shown in FIG. 2.

Two pins 40*a*, 40*b* on either side of the machine center line 80 are base pins of a height H (40 to 55 mm, for example) from the bottom to the top surface of pin heads 41*a*, 41*b* to engage the press block 25 when the hydraulic cushion is pressurized. Therefore, between the lower surface of the press block 25 and those heads, there is only enough clearance to permit the insertion of the spacers into the space 48 above the pins 40 outboard of the pins 40*b* when the hydraulic cushion is relaxed. The pins 40 are arranged in a line outboardly from the pins 40*a*, 40*b*. The height of the pins 40 is lower than the base pin height H so that pressure from the press block 25 is received by the pins 40 through the spacers inserted over the top surface of pin heads 41 and is transmitted to the upper tool 12. A notch 44 is formed in the pin head 41*b* to permit the passage of the spacers 37 as they are inserted into and removed from the space 48 above the top surface of the pin heads 41 (FIG. 3 and FIG. 4).

Mirror image moving means 30 are symmetrically arranged at the left and right sides of the machine center line. Each of the moving means 30 consists of spaced sprockets 33 and 34, and an endless chain 35 extending between sprockets 33 and 34. In order to introduce the spacers 37 from a position next to the center line to a position outboardly of the pins 40*a* and 40*b* on both sides of the center line it is necessary for the chains 35 to travel in opposite directions from one another. The spacers 37 are mounted on the chain by using a link pin of the endless chain 35. The sprocket 33 is a drive sprocket and is driven by a motor 63 connected to a sprocket shaft 31. The sprocket 34 is an idler sprocket.

In the illustrative embodiment shown in FIGS. 3 and 4, spacers 37, 37 are shown inserted in the space above the upper surface of heads 41 of six pins 40, from the third to the fifth pins on the left and right sides from the machine center line 80. An oblique surface 38 is formed on a front edge of the head spacer 37 (see FIG. 4), whereby the leading edge of the spacer can travel through the clearance 48 without contacting the pin head.

When all spacers 37 are inserted in the pin upper surface by driving the chain 35, the maximum width to be accomplished in the bending process (4000 mm for example) is achieved. When all spacers 37 are fully retracted by driving the chain 35 in the reverse direction, the minimum width to be accomplished in the bending process (100 mm for example) is achieved by the four base pins 40*a*, 40*a*, 40*b*, 40*b*.

The endless chain 35 stretched between sprockets 33 and 34, respectively mounted on the driving shaft 31 and a following shaft 32, is actuated by operation of a numerical control system or the like to insert or remove the desired number of spacers 37. The driving shaft 31 has a coupling 64 at its upper end to connect with the motor 63 directly or through a reduction mechanism The shaft has keyed to it the sprocket 33 and, under the sprocket 33, a pulley 26. The driving shaft 31 and a pulley shaft 27 are supported by a box 60 mounted on the side frame 15 (as shown in FIGS. 3 and 5).

In this embodiment, a spacer positioning indicator means 17 is mounted to cooperate with the moving means 30. The indicator means 17 is made up of an attachment 39 mounted on each chain 35, a pair of indicator bands 18, one end of each of which is connected with the attachment 39 to indicate the travel of the chain 35, a groove 66 formed over the full length of the front surface width of the holder 11 for containing the indicator band, pulleys 26 and 28 to wind the band 18 at the lateral side of the holder 11 and a transparent scale 19 mounted on the front surface of the groove 66 to enable an operator to view the travel distance of the band 18. Knowing the position of the attachment on the chain, hence of the spacers 37, permits the operator to determine immediately the upper tool length which will be pressurized by the uniform fluid pressure of the cushion (as shown by FIG. 1, FIG. 2, FIG. 3 and FIG. 5).

The indicator band 18 is stretched between the pulley 26 mounted on the driving shaft 31 and a pulley 28 mounted on vertical shaft 27, positioned in front of the driving shaft 31. The pulley 26 is mounted on the driving shaft 31 via a ball bearing 61, the pulley 28 on the vertical shaft 27 is also supported by the ball bearing (not shown) and travels synchronized with the movement of the attachment 39 mounted on the chain. The rear end of the band 18 is fixed on the attachment 39 of the chain 35 and the forward end, wound and guided by the pulleys 26 and 28, is inserted into the band container groove 66. The transparent scale 19 is mounted on the front surface of the band container groove 66 to view the indicator band 18 therethrough.

A base plate 65 is fixed on the center portion of the longitudinal direction of the band container groove 66 to indicate the minimum upper tool length (1 min.), the front surface of the indicator band 18 inserted in the band container groove 66 is colored the same color as the base plate 65 (white color for example) and at least a vertical wall 67 of the band container groove is colored in an opposite color or in a different color density from the base plate.

Using the machine described above, the bending process to produce a rectangular pan 70 having a long side of 725 mm, a short side of 475 mm and each side rising 15 mm will be explained.

Assuming that each side is to be bent up, a work sheet 70 with a long edge side of 755 mm and a short edge side of 505 mm has a square shape notch of 15 mm each side at the corner portion in order to avoid interference of the meeting corners. Prior to bending the sheet, the machine center line 80 and a center line of the work sheet are adjusted by a centering device (not shown) to set the edge bending length by a back gauge. In this example, for the edge of the short side, eight spacers 37, four on each side, are inserted by actuating the driving sprockets 33 to move the chains 35. The traveling distance of the indicator band 18 is checked via the transparent scale 19 in front of the machine. Thereafter one edge of the short side is bent by pressing down the ram and the other edge of the short side is bent by rotating the work sheet 180°. The bending angle is determined by three points of shoulder portions 57, 58 of the lower tool and height adjustable top surface 59 of the lower tool bottom member 54.

Then the work sheet is turned 90° for centering the long side of the work sheet, fourteen spacers 37 are inserted by driving the driving sprockets 33. As described above, after checking the traveling distance of the indicator band 18 through the transparent window 19, one edge of the long side is bent, and then the other edge of the long side is bent by turning the work sheet 180°.

As described above, in a press brake of a bending machine in accordance with the present invention, an effective upper tool length can be changed automatically in accordance with the bending length of the work sheet.

The press brake according to the present invention prevents a disproportionate load by bending the work sheet symmetrically about the press brake center line automatically both when the central pins are employed alone, and when the spacers are inserted.

For precise bending of a stainless steel sheet, heretofore it has been necessary to remove a slight irregular portion which appears along the boundary line of the split upper tool by a subsequent process; however, in accordance with the press brake of the present invention, there appears no irregular portion on the bending line to be removed, and a precise bending process can be achieved.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A press brake for bending a work sheet comprising:

a ram (10), an upper tool holder (11) mounted on a bottom end of the ram, a hydraulic cushion (20) formed by a hydraulic chamber (21) and a diaphragm (23) closing the bottom of said chamber, extending along the length of the upper tool holder, a press block (25) mounted below and adjacent said hydraulic cushion, an upper tool (12) mounted on a lower portion of the upper tool holder, a bed (13) and a lower tool (14) having spaced shoulders (57, 58) and a height adjustable lower tool bottom member (54);

the upper tool holder including:

a plurality of pressure transmission pins (40*a* 40*b*, 40) symmetrically mounted on either side of a mechanical center line (80) between the press block and the upper tool, at least one of said pins 40*a* and 40*b* on each side of said center line being base pins, and the rest of the pins (40) outboard of said base pins being shorter than said base pins;

a clearance (48) formed between a lower surface of the press block and an upper surface of said shorter pressure transmission pins, a series of spacers (37) carried by a spacer chain (35) for insertion into the clearance, and spacer chain moving means (30) capable of orderly inserting a predetermined number of spacers in the clearance above the upper surface of predetermined numbers of said shorter pressure transmission pins 40 at a selected position from the mechanical center line for making an effective length of the upper tool correspond with the bending length of the work sheet.

2. A press brake for bending a work sheet according to claim 1, the upper tool holder 11 further comprising a cavity 24 to contain the press block 25, a plurality of open-ended passages 46 below the cavity for receiving the pressure transmission pins and two spacer chains 35, 35 on which said spacers 37 are mounted and two chain moving means, said chains and chain moving means being positioned symmetrically on opposite sides of the mechanical center line.

3. A press brake for bending a work sheet according to claim 2 wherein the endless chains 35, 35 travel in opposite directions with respect to each other from the mechanical center line 80 for orderly moving the spacers 37 from a position outside the clearances into respective clearances left and right from the mechanical center line by actuation of said chains in one direction and for moving the spacers 37 out from the clearance 48 by actuation in a reverse direction.

4. A press brake for bending a work sheet according to claim 1 further comprising means 17 for indicating the upper tool length, said means including an attachment 39 mounted on at least one of chains 35, and an indicator band 18 one end of which is connected to the chain by the attachment 39 for indicating the movement of the spacers 37 synchronizing with the movement of the chain 35, a groove 66 formed along the length of a front surface of the holder 11 for containing the indicator band 18 and a transparent scale 19 overlying said groove to permit viewing the movement of the band 18, said movement corresponding to the length of the upper tool subject to a uniform fluid pressure.

5. A press brake for bending a work sheet according to claim 4 characterized in that the means 17 for indicating the upper tool length comprises a pair of left and right pulleys 26, 28 mounted at the side of the band container groove, a pair of left and right side indicator bands 18 for indicating the length of the upper tool subject to uniform fluid pressure from a minimum upper tool length (1 min.) to a maximum upper tool length (1 max.).

6. A press brake for bending a work sheet according to claim 4 characterized in that a colored base plate 65 is fixed on a center portion of a longitudinal direction of the band container groove 66 for indicating the minimum upper tool length (1 min.), a front surface of the indicator band 18 inserted into the band container groove 66 being colored in a same color of the base plate 65 and at least a vertical wall 67 of the band container groove being colored differently from the base plate.

7. In a press brake for bending a work sheet, said brake having a ram, an upper tool holder mounted on a bottom end of the ram, the upper tool holder having a center line midway of its length, a press block mounted in said upper tool holder, and upper tool means mounted on a lower portion of the upper tool holder below said press block, the improvement comprising a plurality of pressure transmission pins symmetrically mounted on either side of said mechanical center line between the press block and said upper tool means, at least one of said pins adjacent each side of said center line being a base pin, and the pins outboard of said base pins being shorter than said base pins; a clearance between a lower surface of the press block and an upper surface of said shorter pressure transmission pins, spacer chains mounted at opposite sides of said center line, a series of spacers carried by said spacer chains for insertion into the clearance, and spacer chain moving means operable for inserting a predetermined number of spacers in the clearance above the upper surface of said shorter pressure transmission pins at selected positions, beginning from the shorter pins closest to the mechanical center line, for making an effective length of the upper tool means, symmetrically about said center line, correspond with a bending length of the work sheet.

8. The improvement of claim 7 including indicator means visible from the front of said brake, for indicating the position of said spacers with respect to said shorter pins.

9. The improvement of claim 7 wherein said spacer chain moving means comprises drive sprockets and idler sprockets around which said spacer chains extend, and motor means for selectively driving said drive sprockets through discrete, predetermined distances.

10. The improvement of claim 7 wherein said drive sprockets on opposite side of said center line rotate in opposite directions.

11. The improvement of claim 7 including a bed (13) and a lower tool (14) mounted on said bed, said lower tool having parallel shoulders (57, 58) and a height-adjustable lower tool bottom member (54), said lower tool being vertically aligned with said upper tool.

* * * * *